US005279429A

United States Patent [19]

Sagel

[11] Patent Number: 5,279,429

[45] Date of Patent: Jan. 18, 1994

[54] PIVOTING TRAY WITH PIVOT BEARING FOR CORNER CUPBOARDS

[75] Inventor: Heinrich Sagel, Brakel-Erkeln, Fed. Rep. of Germany

[73] Assignee: Vauth-Sagel GmbH & Co., Brakel-Erakeln, Fed. Rep. of Germany

[21] Appl. No.: 910,022

[22] PCT Filed: Dec. 22, 1990

[86] PCT No.: PCT/EP90/02294

§ 371 Date: Jul. 22, 1992

§ 102(e) Date: Jul. 22, 1992

[87] PCT Pub. No.: WO91/10379

PCT Pub. Date: Jul. 25, 1991

[30] Foreign Application Priority Data

Jan. 22, 1990 [DE] Fed. Rep. of Germany ..... 9000576.7[U]

Mar. 27, 1990 [DE] Fed. Rep. of Germany .... 4009778.1

[51] Int. Cl.[5] ..... A47F 5/00

[52] U.S. Cl. ..... 211/131; 211/144; 211/163; 312/238

[58] Field of Search ..... 211/131, 144, 77, 78, 211/95, 163; 312/238, 305; 108/94, 95

[56] References Cited

U.S. PATENT DOCUMENTS

| | | | |
|---|---|---|---|
| 2,371,917 | 3/1945 | Rosenberg | 211/131 |
| 4,181,037 | 1/1980 | Boon et al. | 312/238 X |
| 4,440,459 | 4/1984 | Hallgren | 312/238 |
| 4,783,130 | 11/1988 | Twellmann | 312/305 X |

FOREIGN PATENT DOCUMENTS

| | | | |
|---|---|---|---|
| 0193639 | 9/1986 | European Pat. Off. . | |
| 8256885 | 1/1986 | Fed. Rep. of Germany . | |
| 2106109 | 4/1972 | France . | |
| 356349 | 9/1961 | Switzerland | 211/131 |

*Primary Examiner*—Robert W. Gibson, Jr.
*Attorney, Agent, or Firm*—Browdy and Neimark

[57] ABSTRACT

A pivoting tray with a pivot shaft bearing for corner cabinets. The tray has a bottom in the shape of a full or partial arc of a circle, made in one piece of plastic and having a support plate reinforced on the underside by radially extending ribs and a central pivot bearing as well as a laterally circumferentially extending pulled up edge. The ribs are connected to the underside (1*a*) of the support plate (1) and have been widened over a portion of their height into hollow sections.

22 Claims, 5 Drawing Sheets

PIVOTING TRAY WITH PIVOT BEARING FOR CORNER CUPBOARDS

BACKGROUND OF INVENTION

1. Field of the Invention

The invention relates to a pivoting tray with a pivot shaft bearing for corner cabinets with a bottom in the shape of a full or partial arc of a circle, made in one piece of plastic and having a support plate, reinforced on the underside by radially extending ribs, and a central pivot bearing as well as a laterally circumferentially extending pulled up edge.

2. Summary of the Invention

The reinforcing ribs on the underside of such plastic pivoting trays, which are known in various embodiments, are designed with comparatively large and high cross sections for reason of stability, which on the one hand results in a larger plastic material requirement and gives the pivoting tray an undesirable great weight, for which reason the shaft bearing must be reinforced and pivoting movement is made more difficult. Furthermore, the height of the edge defining the receptacle and storage space on the support plate is lost because of the comparatively reinforcing ribs, so that the edge often has too low a securing height.

On the top of the support plate, the known pivoting trays are furthermore provided with ribs extending annularly around the shaft bearing to prevent sliding of the objects placed thereon which, however, do not provide the desired effect for securing the position of the objects during the pivoting movement.

It is therefore the object of the invention to equip a plastic pivoting tray constructed in accordance with the previously mentioned type with a special embodiment of its reinforcement ribs, by means of which it is intended to achieve, along with increased stability, a decreased requirement of material for producing the pivoting tray, to reduce the weight of the pivoting tray and to embody its edge higher for improved security while keeping the total height the same.

Based on the design in accordance with the invention, the following are the advantages of the pivoting tray:

1. Increased stiffness along with a comparatively low rib height has been achieved by means of expanding the fin-shaped ribs on the underside into hollow sections, because of which it is possible to pull up the edge further, so that with the same height of the entire tray (as before) the receptacle space has greater depth and in this way the objects to be stored there are better secured;

2. Less plastic is required because of the shape of the ribs, and the pivoting tray has less weight;

3. The hollow ribs can be easily formed during the injection molding process by means of additional interior gas pressure;

4. Depressed spots in the course of shaping the pivoting tray are prevented by the hollow ribs;

5. The tray can be extruded in faster cycles and taken from the mold at higher temperatures;

6. The radially extending flat ribs on the top provide better protection against slipping for the stored objects when the tray is turned than the customary annularly extending ribs, which provides for the attainment of a further object of improved security against slipping.

The invention furthermore relates to a pivot shaft bearing for the pivoting tray having a support pipe fixed in the corner cabinet, around which the pivoting tray is pivotably secured by means of a basket bearing and is pivotably seated by means of this basket bearing on a basket support, secured against rotation on the support pipe, where the basket bearing and the basket support have slide flanges which are seated on each other.

Such a pivot shaft bearing is known from German Utility Model DE-GM 87 15 548 which, however, is designed for pivoting baskets made of wire.

It is the object of the invention to further develop the known pivot shaft bearing and to provide it with a specially designed pivot basket seal for the pivot bearing of plastic pivot baskets which can be inserted into the pivot shaft bearing in accordance with DE-GM 87 15 548, while keeping the support column and the basket support.

A specially designed pivot basket bearing has been provided by means of the characteristics, which results in a one-piece adapter of plastic which is provided for the pivot bearing of plastic pivoting trays.

This pivot basket bearing is embodied as a flanged bearing and engages grooves in the bearing bushing of the pivot basket with a least one, preferably a plurality of engaging bars formed on it.

The bearing bushing of the pivoting tray is provided with a greater number of grooves than the pivot basket has engaging bars, so that the pivoting tray can be fixed on the pivot basket bearing in variously turned positions. The grooves of the pivoting tray are simply pushed on the engaging bars and it is then supported on the slide flange of the pivot basket bearing.

The further object of a variable pivoting tray device and limiting the end position of the pivoting tray in the corner cabinet is attained by means of this selectively turned operational position of the pivoting tray.

A further great advantage is that this pivot basket bearing represents a further embodiment of the pivot shaft bearing in accordance with DE-GM 87 15 548 and that it can be attached to this pivot shaft bearing while using the already present support column and the basket support.

In this way it is possible to employ selectively both the known pivot shaft bearing for the pivot wire basket and the novel pivot shaft bearing for the plastic pivoting tray with the support column and the basket support; this can be done simply and easily by the user in accordance with his needs by the employment of one or the other pivot basket bearing, The pivot basket bearing is simply and cost-effectively constructed and is easy to install.

BRIEF DESCRIPTION OF THE DRAWINGS

An exemplary embodiment of the invention is illustrated in the drawings and will be described in detail below. Shown are in.

DESCRIPTION OF THE PREFERRED EMBODIMENT(S)

The pivoting tray (pivot basket) for corner kitchen cabinets for storing various household utensils is made of plastic in one piece as a tray in the form of a whole arc or a partial arc.

The pivoting tray has a support plate (1) which has a central pivot bearing (2) for the pivotable seating of the pivoting tray around an upright support column (13) (support pipe).

Figure 3:
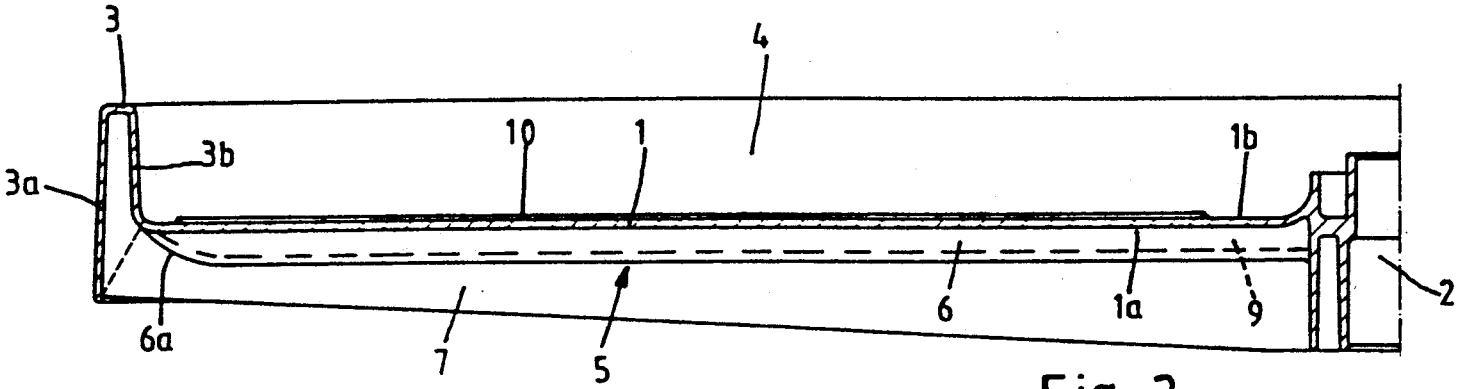
Figure 4:
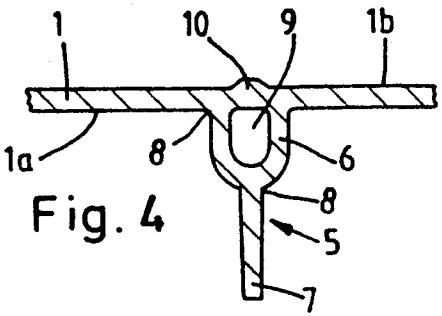

A pulled up edge (3) extends around and is formed on the outside of the support plate (1) and forms, together with the support plate (1), a dish-shaped receptacle (4) for objects to be stored. As shown in FIG. 3, this pulled up edge (3) can be embodied with a double wall and a U-shaped cross section open to the underside, where the outer edge wall (3*a*) is extended downwardly over the support plate (1).

The support plate (1) is reinforced on its underside by radial ribs (5), extending from the pivot bearing (2) to the outer edge wall (3*a*). Connected to the underside (1*a*) of the support plate (1), these ribs (5) have been widened over a portion of their height into hollow sections (6) at the time they were produced, and these hollow sections (6) extend from the pivot bearing (2) in a radial direction as far as the edge (3) and there terminate at the inner edge wall (3*b*), where they form an arc (6*a*) where the edge wall (3*b*) and the support plate (1) abut on each other (FIG. 3).

Each rib (5) consists of a bar (7), placed on edge, and the hollow section (6) located between the bar (7) and the underside (1*a*) of the support plate, which hollow section transitions with its cross section, which is increased in relation to the bar (7), by means of rounded sections (8) into the bar (7) and the support plate (1).

This widened hollow section (6) has a channel (9) extending from the pivot bearing (2) as far as the section arc (6*a*) and is closed off at its longitudinal end by the section arc (6*a*).

Figure 5:
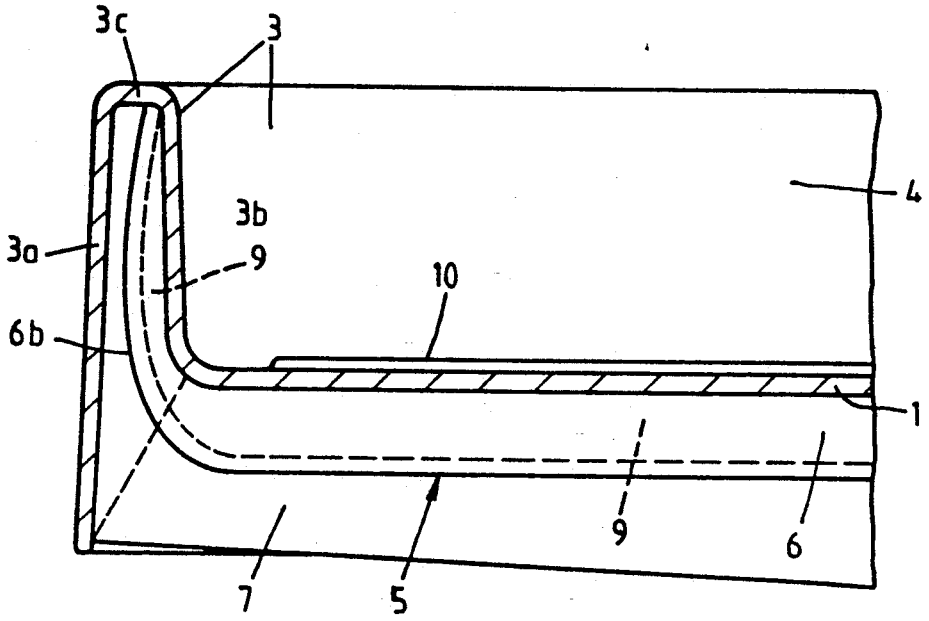
Figure 6:
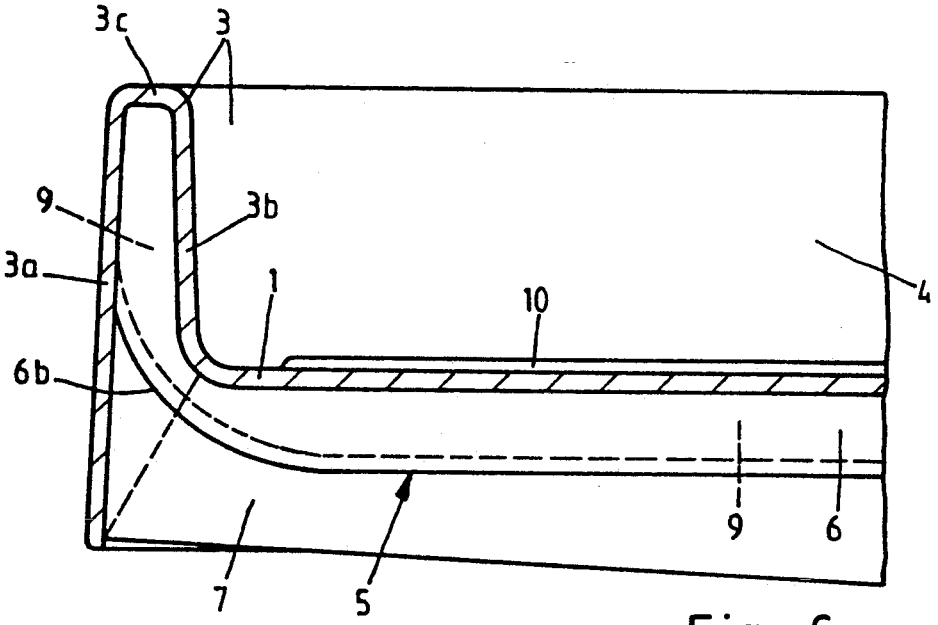
Figure 10:
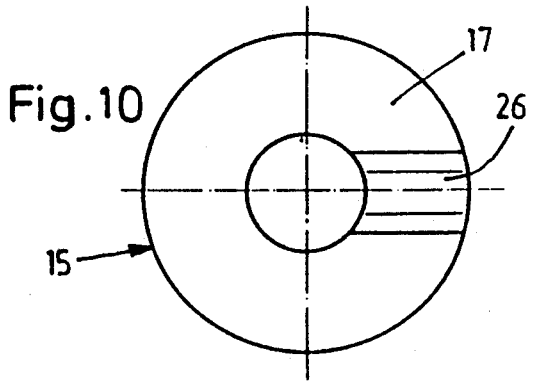
Figure 7:
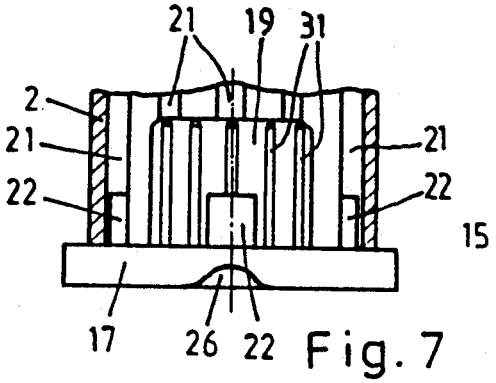
Figure 8:
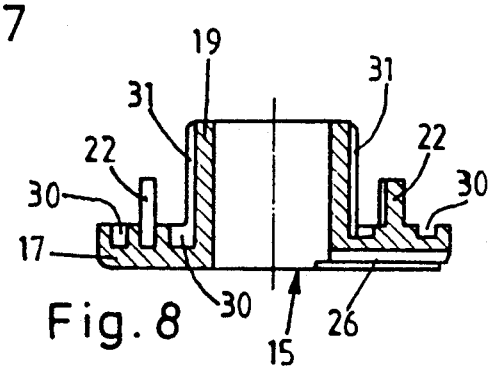
Figure 9:
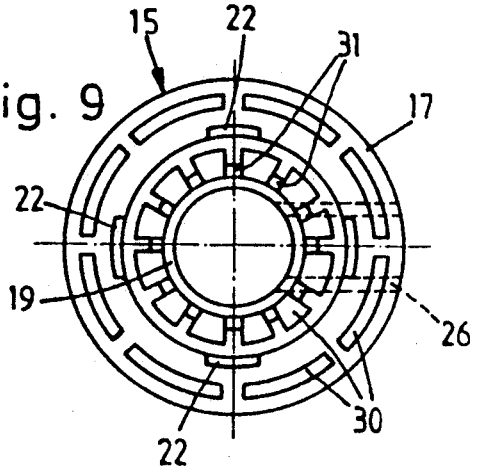

In accordance with the further embodiment of the hollow sections (6) according to FIGS. 5 and 6, these hollow sections (6) are extended in the form of a section arc (6*b*) into the U-shaped section of the edge (3) and terminate underneath the edge bar (3*c*) (FIG. 5) or at the outer edge wall (3*a*) at some distance from the edge bar (3*c*) (FIG. 6), so that in both embodiments the channel (9) is extended around the inner edge wall (3*b*) and is delimited by the arc (6*b*) and the edge wall (3*b*) in accordance with FIG. 5, or it terminates between the two edge walls (3*a*, 3*b*) and the bar (3*c*). The edge (3) has been provided with increased stiffness by means of this hollow section arc (6*b*) extended as far as the U-shaped edge section (3).

Each hollow section (6) has the same height along the entire radial length and each bar (7) is embodied to be slowly decreasing in height starting at the pivot bearing (2) towards the support plate edge (3). The bar (7) is furthermore greater in height at the pivot bearing (2) than the height of the hollow section (6) and at some distance from the support plate edge (3*a*, 3*b*) the bar (7) and the hollow section (6) have approximately the same height. Preferably the hollow section (6) has a cross section in the form of a heraldic shield.

For example, the hollow section (6) has a cross-sectional height of approximately 9 mm and a cross-sectional width of approximately 9 mm, and the bar (7) a height of approximately 30 mm down to approximately 12 mm and a thickness of approximately 2 mm.

Radially extending flat ribs (10) are formed on the top (1*b*) of the support plate (1) to provide protection against sliding for the objects stored in the receptacle (4) of the support plate (1). The ribs (lo) on the top end at some distance from the pivot bearing (2) and the support plate edge (3).

The number of the ribs (10) on the top is greater than that of the ribs (5) on the underside, and a rib (10) on the top is formed in the area of each rib (5) on the underside by means of the hollow section (6), and additional ribs (10) on the top are located between the ribs (5) on the underside.

Each rib (10) on the top has a segmental cross section, the chord of which approximately corresponds to the thickness of the bars (7) on the underside and the segmental height of which corresponds to a portion of the chord length. For example, the chord length is approximately 4 mm and the segmental height approximately 0.7 mm.

Furthermore, the ribs (10) may also have trapezoidal cross sections, in which case the cross-sectional relationships correspond to the segmental cross section.

The bars (7) can also extend into the U-shaped chamber of the edge (3).

Figure 1:
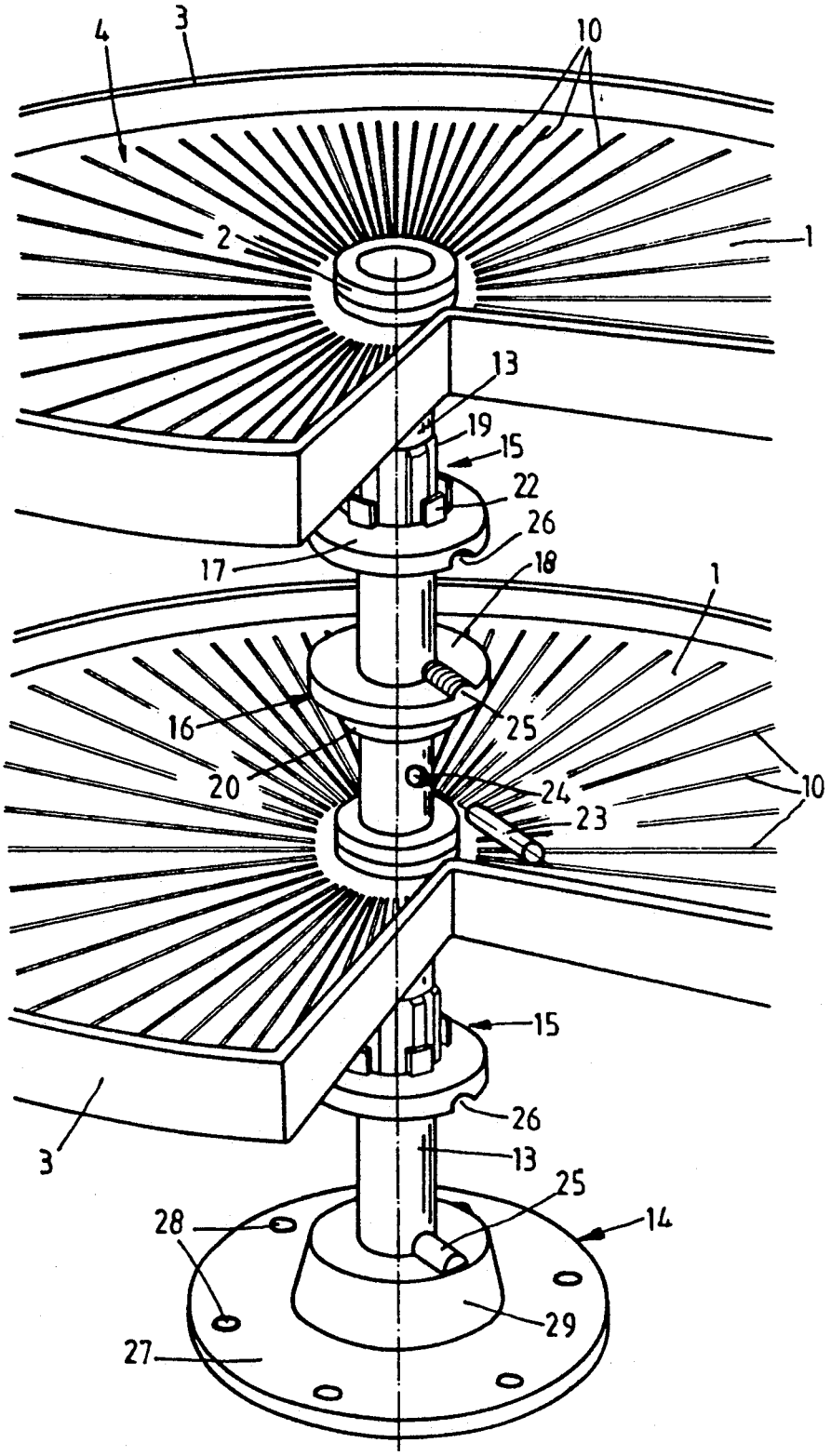
FIG. 1 a perspective exploded view of a pivot shaft bearing with a support column with attachment foot, pivoting trays, basket bearings and basket support, FIG. 2 a pivoting tray, seen from below in the left half and from above in the right half, as well as shown in solid lines as a pivoting tray in the form of a partial arc and in dash-dotted lines as a pivoting tray in the form of a full arc, FIG. 3 a radial section through the pivoting tray half along the section line A—A of FIG. 2, FIG. 4 a cross section through a portion of the pivoting tray along the section line B—B of FIG. 2 with ribs located on the top and underside, FIGS. 5 and 6 a radial section through the outer edge area of the pivoting tray in accordance with section line A—A of FIG. 2 with two different embodiments of the profiled arc end of the lower hollow rib of the pivoting tray, FIG. 7 a side view in section of the basket bearing with the pivoting tray pivot bearing placed on it, FIG. 8 a vertical section through the basket bearing, FIGS. 9 and 10 the two front views of the basket bearing.
Figure 2:
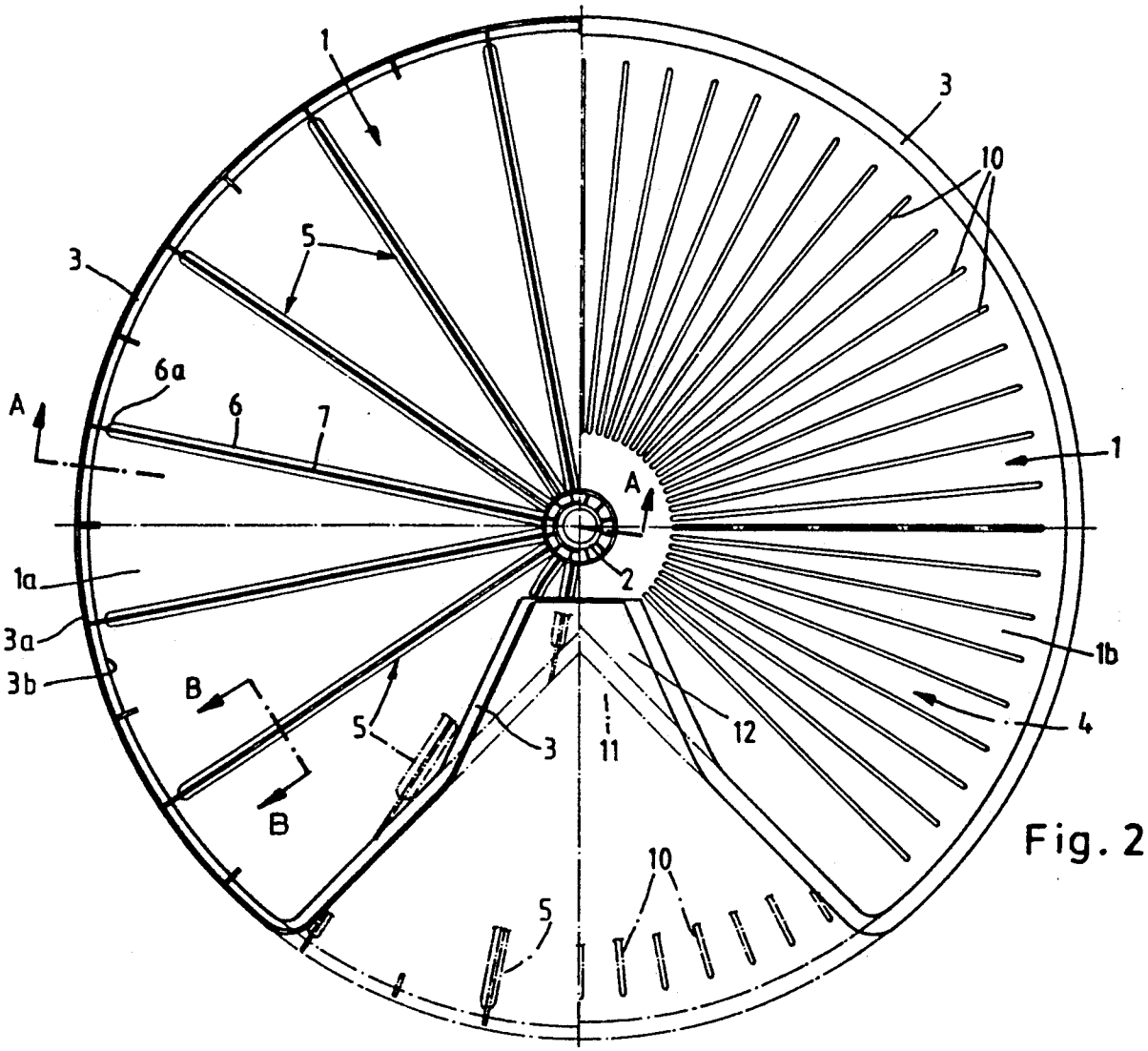

The support plate (1) is embodied as a round, flat disk in the form of a whole or partial arc (the partial arc disk in FIG. 1 is shown in FIG. 1 in solid lines, and the full arc disk is shown in FIG. 1 by dash-dotted lines), where the partial arc disk has a triangular (11) or trapezoidal cutout (12), which is also limited by the edge (3).

The entire pivoting tray is formed by injection in a tool mold, where the plastic material is inserted from the center of the pivoting tray and flows towards the outside. To form the ribs on the underside (5), the bars (7) and the hollow sections (10), the plastic material is pushed into the tool mold by means of injection nozzles acting from the center of the tray, and in each one of these material nozzles there is a nozzle needle, by means of which during the injection of the plastic material a gas, such as nitrogen, is simultaneously injected in the radial direction of the ribs (5) to be produced, because of which the widening (interior gas pressure) of the bars (7) towards the hollow sections (6) and thus the formation of a channel (9) in the hollow section (6) takes place. Polypropylene is preferably employed as the plastic material.

In this connection it is advantageous to add 5 to 30%, preferably 10%, of talcum to the polypropylene.

This plastic material exhibits directed shrinking, higher temperature resistance, advantageous muffling effects when objects are placed on it and is oil- and grease-resistant as well as resistant to food.

The pivot shaft bearing for such corner cabinet pivoting trays has a support pipe (13), fixable in the corner cabinet, with an attachment foot (14), around which pipe the pivoting tray is rotatably supported by a basket bearing (15).

With its basket bearing (15) (tray bearing) the pivoting tray rests on a basket support (tray support) (16), attached fixed against rotation on the support pipe (13), the basket bearing (15) and the basket support (16) having slide flanges (17, 18) resting on top of each other.

The basket bearing (15) is embodied as a flange bushing—slide flange (17) and bushing part (19)—and the basket support (16) also as a flange bushing—slide flange (18) and bushing part (20)—, both parts (15, 16) being made of plastic in one piece each.

The basket bearing (15) represents a one-piece adapter of plastic and has at least one engaging bar (22) formed on it and engaging a groove (21) of the pivot bearing (2) of the pivoting tray.

In a preferred manner the basket bearing (15) has four engaging bars (22), evenly distributed over the circumference and extending from the slide flange (17) in the axial direction of the basket bearing (15), which can be inserted selectively in several axially turned positions of the pivoting tray into its pivot bearing (bearing bushing (2)) having a plurality of grooves (21).

The engaging bars (22) are formed of flat pieces, which are rectangular in cross section, slightly curved in the circumferential direction of the bushing part (19) and taking up a partial area of the height of the bushing part (19).

The slide flanges (17, 18) of the basket bearing (15) and the basket support (16) have a circular basic shape and are embodied with a larger diameter than their bushing parts (19, 20).

The basket support (16) has a reception groove, not shown, located in its bushing part (20), which is engaged by a positioning pin (23) extending through a bore (24) of the support pipe (13) and providing a connection fixed against rotation between the support pipe (13) and the basket support (16).

To seat the pivoting tray pivotably at different heights on the support pipe (13), the latter has bores (24) disposed at a distance above each other, which can be selectively used for the positioning pin (23).

To attain stopping of the pivoting tray (three-quarter arc tray) in an end position, the slide flange (17, 18) of the basket bearing (15) and the basket support (16) is provided with a protruding detent (25) or with a cut-in stop groove (36). The detent (25) and the stop groove (26) have cross sections in the shape of a portion of an arc, because of which, when the pivoting tray is turned, the detent (15) can easily slide out of the stop groove (26) and, in the end position, the detent (25) can easily slide into the stop groove (26).

The detent (25) and the stop groove (26) extend in the radial direction on a radial area of the slide flanges (17, 18) from the bushing bore to the edge of the flange jacket (FIGS. 1, 8, 9 and 20).

The support pipe (13) has an attachment foot (14) of plastic formed by a fastening flange (27) with throughholes (28) for fastening screws and by a frustroconical bearing (29) formed on it and has a detent (25) or a stop groove (26), so that the lowest pivoting tray is pivotable and has locking support on this fastening foot bearing (29).

To save material, the pivot basket bearing (15) is designed with a plurality of cut-outs (30) and is provided with stiffening ribs (31) formed on it for stabilizing it on the thin-walled bushing part (19).

I claim:

1. A pivoting tray said tray having a pivot shaft bearing for corner cabinets with a bottom in the shape of a full or partial arc of a circle, made in one piece of plastic and having a support plate reinforced on the underside by radially extending ribs and a central pivot bearing as well as a laterally circumferentially extending pulled up edge, characterized in that the ribs (5), connected to the underside (1*a*) of the support plate (1), have been widened over a portion of their height into hollow sections (6).

2. A pivoting tray in accordance with claim 1, characterized in that the ribs (5), together with their hollow sections (6) extend from the pivot bearing (2) in a radial direction as far as the support plate edge (3).

3. A pivoting tray in accordance with claim 1, characterized in that each rib (5) consists of a bar (7), placed on edge, and the hollow section (6) located between the bar (7) and the underside (1*a*) of the support plate, which hollow section transitions with its cross section, which is increased in relation to the bar (7), by means of rounded sections (8) into the bar (7) and the support plate (1).

4. A pivoting tray in accordance with one of claim 1, characterized in that each hollow section (6) has a channel (9) extending from the pivot bearing (2) over the entire length of the hollow profile which is closed off at its longitudinal end adjoining the edge (3) by the section arc (6*a*) of the hollow section (3) transitioning into the support plate (1).

5. A pivoting tray in accordance with one of claim 3, characterized in that each hollow section (6) has the same height along the entire radial length and each bar (7) is embodied to be slowly decreasing in height starting at the pivot bearing (2) towards the support plate edge (3).

6. A pivoting tray in accordance with claim 3, characterized in that the bar (7) is greater in height at the pivot bearing (2) than the height of the hollow section (6), and at some distance from the support plate edge (3*a*) the bar (7) and the hollow section (6) have approximately the same height.

7. A pivoting tray in accordance with claim 1, characterized in that the hollow section (6) has a cross section in the form of a heraldic shield.

8. A pivoting tray in accordance with claim 3, characterized in that the hollow section (6) has a section arc (6*b*) which is formed around an inner edge wall (3*b*) into the edge (3) which has a U-shaped section and forms an extended channel (9) terminating in the U-shaped section (3).

9. A pivoting tray in accordance with claim 1, characterized in that the hollow section (6) is shaped into a hollow strand by interior gas pressure injected into rib material during the rib formation.

10. A pivoting tray in accordance with claim 1, characterized in that radially extending flat ribs (10) are formed on the top (1*b*) of the support plate (1) to provide protection against sliding.

11. A pivoting tray in accordance with claim 10, characterized in that ends of the ribs (10) on the top are respectively spaced at some distance from the pivot bearing (2) and the support plate edge (3).

12. A pivoting tray in accordance with claim 10, characterized in that the number of the ribs (10) on the top is greater than that of the ribs (5) on the underside.

13. A pivoting tray in accordance with claim 10, characterized in that a rib (10) on the top is formed in the area of each rib (5) on the underside by means of the hollow section (6).

14. A pivoting tray in accordance with claim 10, characterized in that each said rib (10) on the top has a segmental cross section, the chord of which approximately corresponds to the thickness of the bars (7) on the underside and the segmental height of which corresponds to a portion of the chord length.

15. A pivoting tray in accordance with claim 3, characterized in that support plate edge (3) is embodied to be double-walled with a U-shaped cross section open to the underside, where an outer edge wall (3*a*) is extended downwardly over the support plate (1) and the bars (7) end on it, and the inner edge wall (3*b*), together with the support plate (1) delimits a dishshaped receptacle (4), where the hollow section arc (6*a*, 6*b*) transitions in the area of said inner edge wall (3*b*) into the support plate (1) or the inner edge wall (3*b*), or terminates at the outer edge wall (3*a*).

16. A pivoting tray in accordance with claim 1, characterized in that it is formed in one piece of polypropylene with a talcum addition of 5 to 30%, preferably 10%.

17. A pivoting tray in accordance with claim 1, wherein said tray comprising a pivot shaft bearing, having a support pipe which can be fixed in a corner cabinet, around which the pivoting tray is rotatably supported by a basket bearing and is rotatably seated by means of this basket bearing on a basket support fixed against rotation on the support pipe, where the basket bearing and the basket support have slide flanges resting on each other, characterized in that the basket bearing (15) is produced from a one-piece adapter of plastic and has at least one engaging bar (22) formed on it and engaging a groove (21) of the pivot bearing (2) of the pivoting tray.

18. A pivoting tray in accordance with claim 17, characterized in that the basket bearing (15) is embodied as a flange bushing and has a plurality, preferably four engaging bars (22), evenly distributed on its bushing part (19) over the circumference and extending from the slide flange (17) in the axial direction of the basket bearing (15), which can be inserted selectively in several axially turned positions of the pivoting tray into its pivot bearing (bearing bushing (2)) having a plurality of grooves (21).

19. A pivoting tray in accordance with claim 18, characterized in that the engaging bars (22) are formed of flat pieces, which are rectangular in cross-section, slightly curved in the circumferential direction of the bushing part (19) and taking up a partial area of the height of the bushing part (19).

20. A pivoting tray in accordance with claim 19, characterized in that the slide flanges (17, 18) of the basket bearing (15) and the basket support (16) have a circular basic shape and are embodied with a larger diameter than their bushing parts (19, 20), and that for stopping the pivoting tray, preferably a three-quarter arc tray, in an end position the slide flanges (17, 18) of the basket bearing (15) and the basket support (16) are provided with a protruding detent (25) or with a cut-in stop groove (36), where the detent (25) and the stop groove (26) have cross sections in the shape of a portion of an arc, and extend in the radial direction on a radius area of the slide flanges (17, 18) from the bushing bore to the edge of the flange jacket.

21. A pivoting tray in accordance with claim 20, characterized in that the support pipe (13) has bores (24) disposed at some distance above each other, which can be selectively used for the positioning pin (23) to fix the basket support (16) on the support pipe (13) in a manner to set its height.

22. A pivoting tray in accordance with claim 21, characterized in that the support pipe (13) has an attachment foot (14) of plastic, which is formed by a fastening flange (27) and by a frustroconical bearing (29) formed on it and having a detent (25) or a stop groove (26).

* * * * *